United States Patent [19]

Iimure

[11] Patent Number: 4,501,767

[45] Date of Patent: Feb. 26, 1985

[54] MULTICOAT FORMING METHOD

[75] Inventor: Tamio Iimure, Yawata, Japan

[73] Assignee: Nippon Paint Co., Ltd., Osaka, Japan

[21] Appl. No.: 479,250

[22] Filed: Mar. 28, 1983

[30] Foreign Application Priority Data

Mar. 30, 1982 [JP] Japan ..... 57-51963

[51] Int. Cl.[3] ..... B05D 3/06

[52] U.S. Cl. ..... 427/44; 427/54.1; 204/159.19

[58] Field of Search ..... 427/44, 54.1; 204/159.19

[56] References Cited

U.S. PATENT DOCUMENTS 4,052,280 10/1977 McGinnis ..... 204/159.19

4,113,593 9/1978 Barzynski et al. ..... 204/159.19

4,175,971 11/1979 Shinozaki et al. ..... 430/287

*Primary Examiner*—John E. Kittle

*Assistant Examiner*—James J. Seidleck

*Attorney, Agent, or Firm*—Millen & White

[57] ABSTRACT

A method of forming a multicoat is provided comprising the steps of applying a photocurable colored base coat on a substrate, photocuring the same, applying a clear top coat on the base coat, and then baking the entire multicoat at an elevated temperature. The method is characterized by the use of a polymerizable photocuring accelerator having an aminobenzoyl group and a polymerizable unsaturated group for accelerating the photocuring the base coat.

11 Claims, No Drawings

MULTICOAT FORMING METHOD

BACKGROUND OF THE INVENTION

This invention relates to a method of forming a multicoat on a substrate using a photocurable base coat composition and a top coat composition.

Multi-layered coatings having a colored base coat and a clear or transparent top coat superimposed on the base coat find many important applications in finishing a wide variety of objects for decorative and protective purposes. A method of forming such multicoat includes the steps of applying a photocurable colored base coat composition on a substrate, photocuring the base coat, applying a clear top coat composition on the base coat, and then thermally curing the entire multicoat. This method can prevent the base coat and the top coat from being intermixed prior to curing and thus give an excellent finish, while the length of total curing time may be greatly saved without subjecting the substrate to repeated heating. However, since the base coat is colored and relatively opaque to an activating light, it is imperative for the base coat composition to contain a relatively large amount of a photocuring accelerator such as N,N-dialkylaminobenzoic acid or other tertiary amines. The presence of such accelerator in the cured coating film is not desirable because it adversely affects the water-resistance and the alkali-resistance of the finished coat and the accelerator tends to migrate toward the outer surface resulting in impaired finish upon aging.

Japanese Laid Open Patent Applications Nos. 22536/78, 22537/78 and 22538/78 disclose an accelerator consisting of a reaction product of N,N-dialkyl-p-aminobenzoic acid with an epoxy resin, a polyalkylene glycol or a polyester resin. This accelerator has shown to be unsatisfactory when used in the photocurable base coat composition because it tends to decrease the curability of the coated film and serves as a plasticizer so that the resulting coat exhibits poor chemical and physical characteristics.

Japanese Laid Open Patent Application No. 100498/79 discloses a photo-crosslinkable binder consisting of a reaction product of an epoxy resin, ammonia or an alphatic or alicyclic amine, benzoylbenzoic acid and acrylic or methacrylic acid. When this binder is used particularly in colored opaque coating composition, it decreases the curability of the composition and discolors the finished coat when the coat is baked at a temperature above 200° C.

It is, therefore, an object of the present invention to provide a method of forming a multicoat on a substrate using a photocurable base coat composition and a top coat composition which is free from the above-described problems. Other objects and advantages of the present invention will be apparent to those skilled in the art as the description proceeds.

DESCRIPTION OF THE INVENTION

According to the present invention, there is provided a method of forming a multicoat on a substrate comprising the steps of applying a photocurable colored base coat composition on said substrate, photocuring the base coat, applying a clear top coat composition thereon, and then baking the entire multicoat at an elevated temperature. The improvement comprises the fact that said base coat composition contains a photocuring-accelerating polymer having an aminobenzoyl group, its N-mono- or N,N-di-$C_1$–$C_6$ alkyl substituted group and a polymerizable unsaturated group.

Said polymer may be prepared by reacting (A) o-, m- or p-aminobenzoic acid, or N- or N,N-di-$C_1$–$C_6$ alkyl derivative thereof, (B) a polymerizable unsaturated alcohol or a polymerizable unsaturated carboxylic acid, and (C) an epoxy resin, a polyalkylene glycol, a polyester resin, an acrylic resin, a polycarboxylic acid, a polyisocyanate or a polyepoxide compound. The reaction component (C) must have at least two reaction sites capable of chemically binding said reaction components (A) and (B), respectively.

Since the photocuring accelerator used herein is chemically bound to the film-forming polymer through its polymerizable unsaturated group, the base coat composition containing the same is stable on storage and may be cured into a rigid base coat without discoloration by applying an activating light and subsequently by applying heat with a thermosetting top coat applied thereon.

The clear top coat composition to be used in this invention is a conventional thermocurable or photocurable coating composition. The thermocurable clear coating composition includes, but not limited to, acrylic-melamine clear coatings, polyester-melamine clear coatings, epoxy clear coatings, etc. The photocurable clear coating composition includes, but not limited to, unsaturated bond-crosslinked clear coatings, thiol crosslinked clear coatings, photocurable epoxy clear coating and various combinations thereof.

The colored photocurable base coat composition used herein may contain in addition to the photocuring accelerator described herein, a resin containing polymerizable double bonds (e.g. unsaturated polyester resin, unsaturated polyurethane resin, unsaturated alkyd resin, unsaturated epoxy resin, etc.), a conventional light sensitizer (e.g. benzophenone, benzil, benzoin isopropyl ether, xanthone, thioxanthone, etc.), a conventional colorant (e.g. titanium dioxide, red iron oxide, carbon black, phthalocyanine blue, azo yellow pigment, azo red pigment, etc.), a polymeriable monomer (e.g. trimethylolpropane triacrylate, pentaerythritol tetraacrylate, etc.), an organic solvent, a filler and other additives.

Said accelerator can be prepared by reacting the following components A, B and C.

A. Aminobenzoic acids and their derivatives, e.g., o, m, or p-aminobenzoic acid and their N-mono or -di-$C_1$–$C_6$ alkyl derivatives; preferably p-dimethylamino- or diethylaminobenzoic acid.

B. (I) Polymerizable unsaturated caboxylic acid, e.g., acrylic acid, methacrylic acid, crotonic acid, itaconic acid, maleic acid, maleic anhydride, fumaric acid, fumaric anhydride, etc.

(II) Polymerizable unsaturated alcohol, e.g., 2-hydroxyethyl acrylate, 2-hydroxy-ethyl methacrylate, 2-hydroxypropyl acrylate, 2-hydroxypropyl methacrylate, hexanediol monoacrylate, hexanediol monomethacrylate, glycerol diacrylate, glycerol dimethacrylate, allyl alcohol, etc.

(III) Polymerizable unsaturated epoxy compound, e.g., glycidyl acrylate, glycidyl methacrylate, etc.

C. (I) Epoxy resin, e.g., bisphenol epoxy resin produced by condensation of bisphenol A and epichlorohydrin, novolak epoxy resin produced by condensation of novolak resin and epichlorohydrin, cycloaliphatic epoxy resin having a cyclohexene oxide structure, epoxy resin having a cycloacetal structure, glycol epoxy resin produced by condensation of polyalkylene glycol and epichlorohydrin, epoxidized polybutadiene, epoxidized soybean oil, epoxidized linseed oil, etc.

(II) Polyalkylene glycol, e.g., polyethylene glycol, polypropylene glycol, polytetramethylene glycol, polypentamethylene glycol, polyhexamethylene glycol, etc.

(III) Polyester resin containing groups capable of binding the components A and B. The polyalcohol constituting said polyester resin includes ethylene glycol, low molecular weight polyethylene glycol, propylene glycol, low molecular weight polypropylene glycol, butanediol, hexanediol, neopentyl glycol, trimethylolethane, trimethylolpropane, glycerin, pentaerythritol, etc.

The polycarboxylic acid constituting said polyester resin includes succinic acid, succinic anhydride, adipic acid, sebacic acid, dimer acid, phthalic acid, phthalic anhydride, isophthalic acid, terephthalic acid, trimellitic acid, tetrahydrophthalic acid, tetrahydrophthalic anhydride, hexahydrophthalic acid, hexahydrophthalic anhydride, etc.

(IV) Acrylic copolymer containing functional groups capable of binding the components A and B. Copolymer of a monomer containing functional groups (e.g., 2-hydroxyethyl acrylate, 2-hydroxyethyl methacrylate, 2-hydroxypropyl acrylate, 2-hydroxypropyl methacrylate, glycidyl acrylate, glycidyl methacrylate, acrylic acid, methacrylic acid, maleic anhydride, etc.) with one or more other monomers (e.g., methyl acrylate, methyl methacrylate, ethyl acrylate, ethyl methacrylate, butyl acrylate, butyl methacrylate, benzyl acrylate, benzyl methacrylate, lauryl acrylate, lauryl methacrylate, dimethylaminoethyl acrylate, acrylonitrile, styrene, etc.).

(V) Polycarboxylic acid.

Same as mentioned for the component C (III).

(VI) Polyisocyanate compound (e.g. dimethylene diisocyanate, tetramethylene diisocyanate, hexamethylene diisocyanate, dimer diisocyanate, isophorone diisocyanate, xylylene diisocyanate, tolylene diisocyanate), or a polymerized form thereof, a condensation product thereof with water or an addition product thereof with trimethylol ethane or trimethylol propane, etc.

(VII) Polyepoxy compound (e.g. ethylene glycol diglycidyl ether, propylene glycol diglycidyl ether, hexanediol diglycidyl ether, diglycidyl phthalate, diglycidyl hexahydrophthalate, low molecular weight bisphenol epoxy resin, etc.)

At least one species each of A, B and C must be contained.

Said polymerizable photocuring accelerator can be prepared by reacting the above-mentioned A, B and C components at 80°–150° C., if necessary in the presence of an addition reaction catalyst such as an amine, metal soap, etc., or a condensation catalyst such as sulfuric acid, phosphoric acid, etc.

The accelerator thus obtained is added in an amount sufficient to give a final concentration of 0.05 to 10 weight %, preferably 0.2 to 5 weight %, as aminobenzoic acid, based on the total weight of the nonvolatile content of the colored coating composition. Any lesser proportion of the accelerator does not ensure an adequate curing performance or satisfactory physical properties of the film, while use of an excess of the accelerator over the above range is uneconomical, for it does not result in any further improvement of curing performance.

In photocuring said colored coating composition, light beams having a main wavelength in the range of 200 to 500 nm are used, and as its light source, a conventional carbon arc lamp, a high pressure mercury vapor lamp, a metal halide lamp, or the like may be employed.

The composite coating film thus formed by coating a substrate with the above-mentioned photocurable colored coating composition to provide a base coat and, after photocuring, further with a conventional thermocurable or photocurable clear coating composition undergoes only a minimum of thermal discoloration in the course of heat treatment at a temperature of 100° C. to 300° C. for 1 second to 30 minutes, giving an excellent finished composite coating film. Moreover, the described art of forming a photocurable colored coating composition by incorporating a polymer containing aminobenzoic acid residues and polymerizable double bonds can also be applied to a photocurable ink.

This invention will be illustrated in further detail by way of examples and comparative examples. In these examples, all parts are by weight.

EXAMPLE 1

A flask equippied with a stirrer was charged with 378 parts of epoxy resin (Shell Chemical Co., "Epikote 828": epoxide equivalent, 189) and 16.5 parts of p-dimethylaminobenzoic acid, and the reaction was conducted at 150° C. for 10 minutes. The reaction mixture was then cooled to 120° C. and 1.1 parts of hydroquinone and 133 parts of cellosolve acetate were added. Then, 136.8 parts of acrylic acid was gradually added dropwise over a period of about one hour, keeping the reaction system at the same temperature as above.

After completion of the dropwise addition, the reaction was further conducted at the same temperature until an acid number of less than 4 was obtained. The above procedure gave a polymerizable photocuring accelerator.

EXAMPLE 2

A flask equipped with a stirrer was charged with 213.2 parts of neopentyl glycol, 150 parts of tetrahydrophthalic anhydride, 16.5 parts of p-dimethylaminobenzoic acid and 19 parts of xylene and the reaction was conducted till an acid number of less than 2 was obtained. The reaction mixture was cooled to 80° C., and 224 parts of n-butyl acetate, 376 parts of xylylene diisocyanate (a mixture of $\omega$, $\omega'$-diisocyanato-1,3-dimethylbenzene and $\omega$, $\omega'$-diisocyanato-1,4-dimethylbenzene) and 4 parts of dibutyltin dilaurate were added. The reaction was further conducted for 30 minutes, after which 232 parts of 2-hydroxyethyl acrylate was gradually added dropwise over a period of about one hour.

After completion of the dropwise addition, the mixture was further reacted under stirring at the same temperature until it was confirmed by infrared spectrophotometry that all the isocyanate groups had been reacted. The above procedure gave a polymerizable photocuring accelerator.

EXAMPLE 3

A flask fitted with a stirrer was charged with 213.2 parts of neopentyl glycol, 152 parts of tetrahydrophthalic anhydride and 18.3 parts of xylene, and the reaction was conducted at 180° C. until an acid number of less than 2 was obtained. The reaction mixture was then cooled to 80° C., and 221 parts of n-butyl acetate, 376 parts of xylylene diisocyanate and 4 parts of dibutyltin dilaurate were added thereto and, after a further 30-minute reaction, 232 parts of 2-hydroxyethyl acrylate was gradually added dropwise at the same temperature as above over a period of about one hour.

After completion of the dropwise addition, the mixture was further reacted under stirring until it was confirmed by infrared spectrophotometry that all the isocyanate groups had been reacted. The above procedure gave a polymerizable photocurable polymer.

EXAMPLE 4

A flask fitted with a stirrer was charged with 378 parts of epoxy resin (Shell Chemical Co., "Epikote 828": epoxide equivalent 189) and 330 parts of p-dimethylaminobenzoic acid and the reaction was conducted at 180° C. until an acid number of less than 5 was obtained. Thereto, 177 parts of cellosolve acetate was added to give a photocuring accelerator.

EXAMPLE 5

A flask fitted with a stirrer was charged with 378 parts of epoxy resin (Shell Chemical Co., "Epikote 828"; epoxide equivalent 189), 10.5 parts of diethanolamine, 22.6 parts of o-benzoylbenzoic acid, 132 parts of cellosolve acetate and 0.5 parts of hydroquinone and, then, 115 parts of acrylic acid was gradually added dropwise at 120° C. over a period of about one hour.

After completion of the dropwise addition, the reaction was conducted until an acid number of less than 5 was obtained. The above procedure gave a polymerizable photocuring accelerator.

EXAMPLE 6

A flask fitted with a stirrer was charged with 378 parts of epoxy resin (Shell Chemical Co., "Epikote 828"), 2.6 parts of diethylaminoethyl methacrylate, 1 part of hydroquinone and 131 parts of cellosolve acetate and, then, 144 parts of acrylic acid was gradually added dropwise at 120° C. over a period of about 2 hours.

After completion of the dropwise addition, the reaction was conducted until an acid number of less than 8 was obtained. The above procedure gave a photocurable polymer.

EXAMPLE 7

A flask fitted with a stirrer was charged with 83.1 parts of isophthalic acid, 46 parts of neopentyl glycol, 13.5 parts of trimethylol propane, 0.29 parts of dibutyltin oxide and 7 parts of xylene and the dehydration condensation reaction was conducted at 220° C. until an acid number of less than 5 was obtained. The reaction mixture was then dissolved with 60 parts of xylene and 28.5 parts of cellosolve acetate to give a thermocurable polyester copolymer and 159 parts of melamine resin (Mitsui Toatsu Chemicals Inc. "Yuban 125") was added thereto to give a thermocurable clear coating composition.

EXAMPLE 8

Sixty parts of trimethylolpropane triacrylate, 50 parts of the photocuring accelerator of Example 1, 4 parts of benzophenone, 4 parts of benzil and 150 parts of titanium dioxide pigment were mixed and dispersed to give a photocurable colored coating composition.

The above composition was applied to a cleaned, polished mild steel plate with a bar coater to a thickness of 10 microns (dry thickness), and the film was allowed to stand at room temperature for 2 hours to sufficiently evaporate the solvent in the film. Then, the film was irradiated with a 4-kW metal halide lamp model MI-40N equipped with a condensing plate reflector (Japan Storage Battery Co., Ltd.) for 0.6 second. The film was evaluated for various characteristics. The results are shown in Table 1.

Furthermore, the thermocurable clear coating composition of Example 7 was applied onto the above film to a thickness of 7 microns (dry thickness). The film was baked at 190° C., 210° C., 230° C. or 250° C. for 5 minutes and the color difference between before and after baking was determined. The results are shown in Table 2.

COMPARATIVE EXAMPLE 1

Sixty parts of trimethylolpropane triacrylate, 50 parts of the polymerizable photocuring accelerator of Example 5, 4 parts of benzil and 150 parts of a titanium dioxide pigment were mixed and dispersed to give a photocurable colored coating composition. Using this composition, the procedure of Example 8 was followed to give a coating film. The results of evaluation of this film are shown in Table 1.

Furthermore, a film of the thermocurable clear coating composition of Example 7 was formed on the above coating film by the procedure of Example 8. The film was baked at 190° C., 210° C., 230° C. or 250° C. for 5 minutes and evaluated for color difference between before and after baking. The results are shown in Table 2.

EXAMPLE 9

Sixty parts of pentaerythritol triacrylate, 50 parts of the photocuring accelerator of Example 2, 5 parts of benzil dimethyl ketal and 50 parts of a red colorant (Tone Kogyo Co. "Tenyo iron oxide red 501") were mixed and dispersed to give a photocurable coating composition. This composition was applied to a cleaned, polished mild steel plate with a bar coater to a thickness of 10 microns (dry thickness) and the film was allowed to stand at room temperature for 2 hours to sufficiently evaporate the solvent in the film. The film was irradiated with a 4-kW high pressure mercury vapor lamp model HI-40N equipped with a condensing plate reflector (Japan Storage Battery Co.) for 0.8 second. The results of evaluation of the film are shown in Table 1.

Furthermore, a photocurable clear coating composition consisting of 40 parts of bis(acryloxyethoxyethyl)phthalate, 30 parts of trimethylolpropane triacrylate, 30 parts of bisphenol A-ethylene oxide (4 moles) adduct diacrylate (Osaka Yuki Co., "Viscoat 700") and 3 parts of $\alpha$, $\alpha$-diethoxyacetophenone was applied to the above film to a thickness of 7 microns (dry thickness). The film was irradiated with a 4-kW high pressure mercury vapor lamp model HI-40N and a condensing plate reflector (Japan Storage Battery Co.) for 0.3 second and baked at 190° C. 210° C., 230° C. or 250° C. for 5 minutes. The baked film was evaluated for color difference between before and after baking. The results are shown in Table 2.

COMPARATIVE EXAMPLE 2

Sixty parts of pentaerythritol triacrylate, 46 parts of the photocurable polymer of Example 3, 4 parts of the accelerator of Example 4, 5 parts of benzil dimethyl ketal and 50 parts of a red colorant (Tenyo iron oxide red 501, mentioned hereinbefore) were mixed and dispersed to give a photocurable coating composition.

Using this composition, the procedure of Example 9 was followed to give a coating film. The results of evaluation of this film are shown in Table 1.

The same photocurable clear coating composition as mentioned in Example 9 was further applied to the above film and the procedure of Example 9 was repeated to give a top coat. This composite film was then baked in 190° C., 210° C., 230° C. or 250° C. for 5 minutes and evaluated for color difference between before and after baking. The results are shown in Table 2.

EXAMPLE 10

Sixty parts of bisphenol A-ethylene oxide (4 moles) adduct diacrylate (Viscoat 700, mentioned hereinbefore), 50 parts of the photocuring accelerator of Example 1, 5 parts of benzoin isopropyl ether and 20 parts of a blue colorant (Dainichi Seika Co., "Prussian Blue N-650") were mixed and dispersed to give a photocurable coating composition. Using this composition, the procedure of Example 9 was repeated to give a coating film. The results of evaluation of this film are shown in Table 1.

Then, a top coat film of the thermocurable clear coating composition of Example 7 was formed on the above film by the procedure of Example 8. This composite film was baked at 190° C., 210° C., 230° C. or 250° C. for 5 minutes and evaluated for color difference between before and after baking. The results are shown in Table 2.

COMPARATIVE EXAMPLE 3

Sixty parts of bisphenol A-ethylene oxide (4 moles) adduct diacrylate (Viscoat 700, mentioned hereinbefore), 50 parts of the photocurable polymer of Example 6, 3 parts of isoamyl p-dimethylaminobenzoate, 5 parts of benzoin isopropyl ether and 20 parts of a blue colorant (Prussian Blue N-650, mentioned hereinbefore) were mixed and dispersed to give a photocurable colored coating composition. Using this composition, the procedure of Example 9 was followed to give a coating film. The results of evaluation of this film are shown in Table 1.

Then, an additional film of the thermocurable clear coating composition of Example 7 was formed on the above film. The composite film was baked at 190° C., 210° C., 230° C. for 5 minutes and evaluated for color difference between before and after baking. The results are shown in Table 2.

TABLE 1

| Example | Item | | | |
|---|---|---|---|---|
| | Adhesion | Hardness | Solvent resistance | Boiling water resistance |
| Ex. 8 | O | 3H | O | O |
| Com. Ex. 1 | X | 2B | X | X |
| Ex. 9 | O | 2H | O | O |
| Com. Ex. 2 | Δ | H | Δ | Δ |
| Ex. 10 | O | 2H | O | O |
| Com. Ex. 3 | Δ | F | Δ | Δ |

TABLE 2

| Example | Item ΔE Baking temperature | | | |
|---|---|---|---|---|
| | 190° C. | 210° C. | 230° C. | 250° C. |
| Ex. 8 | 0.82 | 0.97 | 1.01 | 1.52 |
| Com. Ex. 1 | 1.98 | 2.74 | 3.54 | 3.92 |
| Ex. 9 | 1.15 | 1.21 | 1.38 | 1.92 |
| Com. Ex. 2 | 1.85 | 2.01 | 2.13 | 3.88 |

TABLE 2-continued

| Example | Item ΔE Baking temperature | | | |
|---|---|---|---|---|
| | 190° C. | 210° C. | 230° C. | 250° C. |
| Ex. 10 | 0.82 | 0.85 | 0.90 | 1.00 |
| Com. Ex. 3 | 2.99 | 3.83 | 4.27 | 5.21 |

Adhesion: Cross-hatch tape test (1 mm square)
O: More than 80% upeeled
Δ: 80–30% unpeeled
X: Less than 30% unpeeled Hardness: Pencil test (with a Mitsubishi "Uni" pencil)

Solvent resistance: The surface is rubbed by reciprocating 50 times a flannel cloth soaked in acetone
O: No change
Δ: Dissolved to some extent
X: Dissolved completely Boiling water resistance: 60 minutes' immersion in boiling water
O: No change
Δ: Some blistering
X: Marked blistering Discoloration: Apparatus by Toyo Rikagaku Kogyo, K.K.

The color difference between the unbaked film and the baked film is determined as follows.

The values of L, a and b are read on Hunter's color scale and the color difference in terms of NBS is calculated.

The color difference ($\Delta E$) =

$$\sqrt{(L_s - L_T)^2 + (a_s - a_T)^2 + (b_s - b_T)^2}$$

wherein:

$L_s$, $a_s$ and $b_s$: the values of L, a and b determined on the unbaked film $L_T$, $a_T$ and $b_T$: the values of L, a and b determined on the baked film It is to be understood that the foregoing are given merely by way of illustration and that many variations may be made therein without departing from the scope of the present invention. For example, various patterns, signs and the like may be printed on the colored base coat after photocuring thereof but prior to applying a clear top coat thereon using a photocurable or thermosetting ink.

What is claimed is:

1. A method of forming a multicoat coating on a substrate which comprises the steps of applying on said substrate a photocurable colored base coat containing a photocurable film-forming polymer, a photosensitizer capable of photochemically inducing free radical addition polymerization of said photocurable film-forming polymer and a photocuring accelerator which is an unsaturated polymerizable polymer having an aminobenzoyloxy or N-mono or N,N-di-$C_1$–$C_6$ alkyl substituted aminobenzoyloxy group; photocuring said base coat; applying a clear top coat on said base coat; and then baking the resulting multicoat at an elevated temperature.

2. The method of claim 1, wherein said photocuring-accelerating polymer is a reaction product of (A) o-, m-, p-aminobenzoic acid, their N-mono- or N,N-di-$C_1$–$C_6$ alkyl derivatives, (B) a polymerizable unsaturated carboxylic acid or a polymerizable unsaturated alcohol, and (C) an epoxy resin, a polyalkylene glycol, a polyester resin, an acrylic copolymer, a polycarboxylic acid, a polyisocyanate, or a polyepoxy compound, said reaction component (C) having at least two reaction sites capable of binding said reaction component (A) and (B), respectively.

3. The method of claim 2, wherein said photocuring-accelerating polymer is present in said base coat from 0.05 to 10% by weight as the corresponding aminobenzoic acid based on the total weight of the nonvolatile content of the base coat.

4. The method of claim 3, wherein said photosensitizer is benzophenone, benzil, benzoin isopropyl ether, xanthone or thioxanthone.

5. The method of claim 2, wherein said reaction component (A) is N,N-dimethyl- or N,N-diethyl-p-aminobenzoic acid.

6. The method of claim 2, wherein said clear top coat is of photocurable type, and further comprising the step of photocuring said clear top coat prior to baking the entire multicoat.

7. The method of claim 2, wherein said clear top coat is of thermosetting type.

8. The method of claim 2, wherein said baking is carried out at a temperature of 100° C. to 300° C. for 1 second to 30 minutes.

9. The method of claim 2, wherein said reaction component (C) is an epoxy resin and said reaction component (B) is a polymerizable unsaturated acid.

10. The method of claim 2, wherein said reaction component (B) is a polymerizable unsaturated alcohol and said reaction component (C) is a polyester resin and a diisocyanate.

11. The method of claim 2 wherein said clear top coat is of thermosetting type; wherein said photosensitizer is benzophenone, benzil, benzoin isopropyl ether, xanthone or thioxanthone; wherein said reaction component (A) is N,N-dimethyl- or N,N-diethyl-p-aminobenzoic acid; wherein said reaction component (B) is acrylic acid or 2-hydroxyethylacrylate and reaction component (C) is a diisocyanate or a mixture of a diisocyanate polyester resin.

* * * * *